US010039399B2

(12) United States Patent
Cunningham

(10) Patent No.: US 10,039,399 B2
(45) Date of Patent: Aug. 7, 2018

(54) FLUIDIC UTENSILS

(71) Applicant: Kenneth Thomas Cunningham, Hazlet, NJ (US)

(72) Inventor: Kenneth Thomas Cunningham, Hazlet, NJ (US)

( * ) Notice: Subject to any disclaimer, the term of this patent is extended or adjusted under 35 U.S.C. 154(b) by 331 days.

(21) Appl. No.: 14/217,290

(22) Filed: Mar. 17, 2014

(65) Prior Publication Data

US 2015/0047205 A1 Feb. 19, 2015

Related U.S. Application Data

(63) Continuation-in-part of application No. 12/321,943, filed on Jan. 27, 2009, now abandoned.

(51) Int. Cl.

| | |
|---|---|
| ***A47G 21/00*** | (2006.01) |
| ***A47G 21/02*** | (2006.01) |
| ***A47G 21/10*** | (2006.01) |
| ***A47G 21/06*** | (2006.01) |
| ***A47G 21/18*** | (2006.01) |

(52) U.S. Cl.

CPC ..... *A47G 21/004* (2013.01); *A47G 21/02* (2013.01); *A47G 21/023* (2013.01); *A47G 21/103* (2013.01); *A47G 21/181* (2013.01)

(58) Field of Classification Search

CPC .... A47G 21/004; A47G 21/02; A47G 21/023; A47G 21/103; A47G 21/181

USPC ..... 30/123.3, 124, 125, 128, 141, 322–324, 30/340–344, 526, 535–538, DIG. 6; 222/191

See application file for complete search history.

(56) References Cited

U.S. PATENT DOCUMENTS

| | | | | |
|---|---|---|---|---|
| 285,054 | A | 9/1883 | Moffitt | |
| 569,831 | A | 10/1896 | Hurlburt | |
| 674,446 | A | 5/1901 | Marx | |
| 1,155,802 | A | 10/1915 | Dennis | |
| 1,317,691 | A * | 10/1919 | Fields | A47G 21/004 222/191 |
| 1,606,038 | A | 11/1926 | Norman | |
| 1,661,595 | A * | 3/1928 | Bowen | A22C 17/0053 99/532 |
| 1,857,712 | A | 5/1932 | De Martini | |
| 2,334,535 | A | 11/1943 | Bandell | |
| 2,453,525 | A * | 11/1948 | McNeill | A61J 7/0023 30/123.3 |
| 2,859,515 | A | 11/1958 | Harold | |
| 3,410,457 | A * | 11/1968 | Brown | A47G 21/004 222/191 |
| 4,182,002 | A * | 1/1980 | Holec | A22C 9/001 99/532 |
| D259,533 | S | 6/1981 | Frodsham | |

(Continued)

OTHER PUBLICATIONS

M. Perton; Rakuten sauce-dispensing chopsticks : Engadget; Dec. 31, 2005; U.S.A.; www.engadget.com/2005/12/31/rakuten-sauce-dispensing-chopsticks-for-when-you-just-cant-wait/.

*Primary Examiner* — Clark F Dexter
(74) *Attorney, Agent, or Firm* — William M. Fischer

(57) ABSTRACT

Eating utensils, namely forks which have the function of liquid dispensing fluid, via fluidic passages inside of the utensils which attach to a container of a liquid affixed at a point within a cage part of the handle of the utensil. The attachment coupled with the action of the user of the utensil actuates the flow of the liquid from the container to a point on or near the eating surface of the utensil.

13 Claims, 4 Drawing Sheets

(56) References Cited

U.S. PATENT DOCUMENTS

| | | | | | |
|---|---|---|---|---|---|
| 4,653,188 | A | * | 3/1987 | Kwak | B26B 21/446 30/41 |
| 4,760,642 | A | * | 8/1988 | Kwak | A46B 11/0024 132/289 |
| 4,888,188 | A | * | 12/1989 | Castner et al. | A47G 19/183 126/263.03 |
| 4,957,226 | A | | 9/1990 | Pacia | |
| 5,038,476 | A | | 8/1991 | Mccrea | |
| 5,402,697 | A | * | 4/1995 | Brooks | B26B 19/40 30/34.2 |
| 5,727,321 | A | | 3/1998 | Lewis | |
| 5,873,167 | A | | 2/1999 | Mason | |
| D440,810 | S | | 4/2001 | Olson | |
| 6,463,662 | B1 | | 10/2002 | Coscia et al. | |
| 7,047,648 | B1 | | 5/2006 | LeBel et al. | |
| 8,607,459 | B2 | | 12/2013 | Geissler | |
| 2004/0006874 | A1 | | 1/2004 | Kamm et al. | |

* cited by examiner

FLUIDIC UTENSILS

CROSS-REFERENCE TO RELATED APPLICATIONS

The application is a continuation-in-part of co-pending U.S. application Ser. No. 12/321,943 filed Jan. 27, 2009, now abandoned, in the name of the same inventor, Kenneth Thomas Cunningham.

FIELD OF INVENTION

This invention relates generally to the field of eating utensils, mainly and specifically forks.

STATEMENT REGARDING FEDERALLY FUNDED RESEARCH

This invention was not made under contract with an agency of the US Government, nor by any agency of the US Government.

BACKGROUND OF THE INVENTION

U.S. Pat. No. 1,661,595 to Bowen (Mar. 6, 1928) teaches a meat seasoning fork, a cooking utensil rather than an eating utensil, which has a syringe-like arrangement in the hollow handle. It would seem that that device would be difficult to clean easily. It lacks a cage structure, disposable, interchangeable polymer bags and so on.

U.S. Pat. No. 4,653,288 to Kwak (Mar. 31, 1987) teaches a disposable razor blade rather than an eating implement. The razor has on one side a WINDOW and on the top a slide which pushes an internal tube to force shaving ointment from the head end of the device. Although the hollow handle has a window and a slide, the device lacks a cage and furthermore lacks disposable interchangeable polymer bags and so on. (The exemplary FIG. 1 of the Kwak reference shows a body having a number of longitudinal lines on the top and visible side, thus offering the appearance of a cage. FIG. 3 of the reference reveals the actual structure of the handle: a hollow body with a single opening on the top and a transparent side.)

U.S. Pat. No. 3,410,457 to Brown (Nov. 12, 1968) teaches another seasoning fork rather than an eating utensil having interchangeable squeeze bottles of some elastic material, but again has no cage. It is worth noting that since seasoning will be present in the entire length of the hollow handle, when a new squeeze bottle is installed at the top and squeezed, the first product dispensed will actually be the seasoning which was no longer desired.

Castner Sr, et al, U.S. Pat. No. 4,888,188 (Dec. 19, 1989) teaches food dispensers, with heating elements in the form of utensils for babies, but again has no cage, no interchangeable squeeze bags, etc.

It would be preferable to provide a device which lacks the complexity seen in the prior art, and which allows quick and convenient changing of one condiment for another.

It would be preferable to provide an actual eating utensil for adults, rather than a seasoning fork or the like.

SUMMARY OF THE INVENTION

The present invention teaches it is possible to impart the function of liquid dispensing to eating utensils, specifically forks. Inside the utensils are fluidic passages connecting to a container of a liquid affixed at a point within the handle of the utensil. The fluid in the container attached to the utensil is allowed to flow through the passages in order to be dispensed at a point at the bottom end of the utensil, the bottom end being the working end. In the case of a fork, the working end contains an ordinarily shaped fork having at least two prongs. Fluid dispensing is actuated by gravity after the container is affixed or by manual pressure, as in squeezing the container. These fluidic utensils are also useful in applications for dispensing food condiments. Dispensing fluids in this way is advantageous since the user may control the volume of fluid dispensed and the location the fluid is dispensed to.

It is therefore one aspect, advantage, objective and embodiment of the present invention, in addition to those described above, to provide a fluidic utensil comprising:

a) a working end fork structure, said working end fork structure having at least two fork prongs;

b) a first exit hole, said hole located upon an end of at least one of said two fork prongs;

c) a handle, wherein a portion of said handle is constructed as a hollow cage, said cage having at least three cage legs, said cage legs extending down from a top of said handle opposite said working end to a lower portion of said handle meeting said working end, said lower portion having a fluid receiver at the lower end of said hollow cage, said fluid receiver forming an orifice facing upward into said cage;

d) at least one internal fluid passage, said internal fluid passage extending from said orifice at a bottom of said fluid receiver to said exit hole located upon said at least one of said two fork prongs; and, e) a fluid container having a nozzle end extending into said fluid receiver and dimensioned and configured to mechanically engage thereto, the fluid container dimensioned and configured to fit inside said hollow cage between said cage legs whereby flow of liquid from said fluid container into said internal fluid passage and then to said exit hole is allowed.

It is therefore one aspect, advantage, objective and embodiment of the present invention, in addition to those described above, to provide a fluid utensil further comprising:

f) a removable top enclosure structure, atop said cage legs at said top of the handle.

It is therefore one aspect, advantage, objective and embodiment of the present invention, in addition to those described above, to provide a fluidic utensil further comprising:

a second exit hole located upon an end of a second one of said two fork prongs, said fluid passage having at least one branch, said branching fluid passage extending from said exit holes through the inside of said prongs to an internal junction inside of said working end at an internal point approximating a juncture of said working end fork structure with said lower portion of said handle.

It is therefore one aspect, advantage, objective and embodiment of the present invention, in addition to those described above, to provide a fluidic utensil wherein:

said exit hole is located on a top surface of said working end fork structure between said prongs and a juncture of said working end with said lower portion of said handle.

It is therefore one aspect, advantage, objective and embodiment of the present invention, in addition to those described above, to provide a fluidic utensil wherein said fluid container is a disposable polymer bag.

It is therefore one aspect, advantage, objective and embodiment of the present invention, in addition to those described above, to provide a fluidic utensil, wherein the disposable polymer bag has approximately zero elasticity.

It is therefore one aspect, advantage, objective and embodiment of the present invention, in addition to those described above, to provide a fluidic utensil, wherein the cage legs are flexible, whereby when pressure is applied to the cage legs, they deform inward and squeeze the disposable polymer bag.

It is therefore one aspect, advantage, objective and embodiment of the present invention, in addition to those described above, to provide a fluidic utensil, wherein the cage legs are disposed far enough apart to allow a user to extend their fingers between the cage legs to squeeze the disposable polymer bag.

It is therefore one aspect, advantage, objective and embodiment of the present invention, in addition to those described above, to provide a fluidic utensil, wherein the cage further comprises: four cage legs, and four voids therebetween, each leg separated from adjoining legs by a void on either side, each void permitting both visual and physical access to the interior of the hollow cage, whereby users may see the interior of the hollow cage, the contents of the fluid container, and may squeeze the fluid container on opposite sides.

BRIEF DESCRIPTION OF THE DRAWINGS

In FIGS. 1A and 1B, the dashed lines denote the internal fluid passages found within the utensil through which fluid is dispensed from a container piece containing a liquid. FIGS. 1A and 1B show two fork embodiments of the claimed invention.

INDEX OF REFERENCE NUMERALS

Figure 1A:
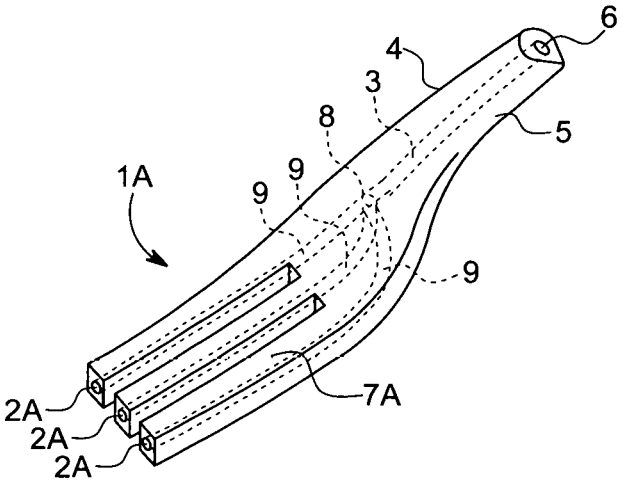
FIGS. 1A and 1B depict perspective views of the working ends of two embodiments of the claimed invention.

Exit holes 2A, 2B
Internal fluid passage 3
Outer surface 4
Material 5
Interior surface 6
Prongs 7A, 7B
Internal junction 8
Internal branching fluid passages 9
Hollow enclosure structure 10
Top enclosure structure 11
Receiver 14
Fluid container 15
Container nozzle 16A, 16B
Luer lock 17
Nozzle shaft 18A, 18B
Screw threads 21
Protective cover 22
Matching fittings 23A, 23B

DETAILED DESCRIPTION

Figure 1B:
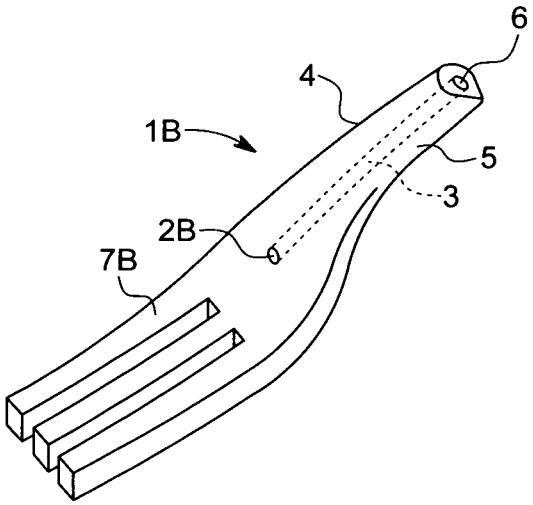
Figure 2:
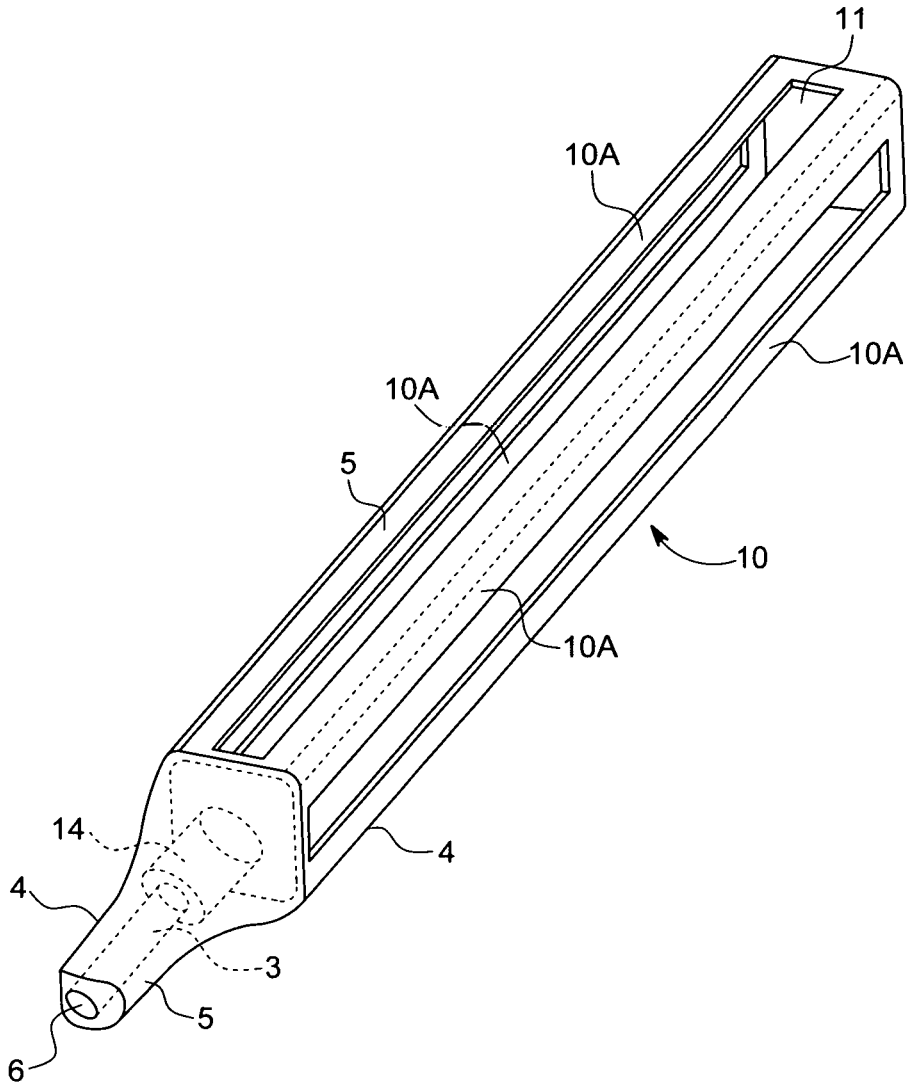
FIG. 2 depicts a perspective view of the handle body portion of the claimed invention.

It is therefore a preferred embodiment and best mode now contemplated for carrying out the invention as shown in FIGS. 1 through 3.

FIGS. 1A and 1B of the drawings depict the working ends of two embodiments of a fork 1A, 1B of the claimed invention.

In FIG. 1A, dashed lines depicting the internal fluid passages 39 extend to at least one of the tips of the fork 1A, the fork 1A having at least two prongs 7A. Fluid passages 9 exit at openings 2A at the tips of the fork prongs 7A after branching off from a single passage 3 extending through the body of the utensil handle. The point of the branching is an internal junction 8 located inside the utensil at any point between the inner edges of the fork prongs 7A adjacent to the utensil handle body and the juncture of the working end with the handle body. In FIG. 1A, the fluid passages 3, 9 shown by dashed lines extend through and exit the utensil at any point between the inner edges of the fork prongs 7A adjacent to the utensil handle body and the juncture of the working end with the handle body.

Figure 3A:
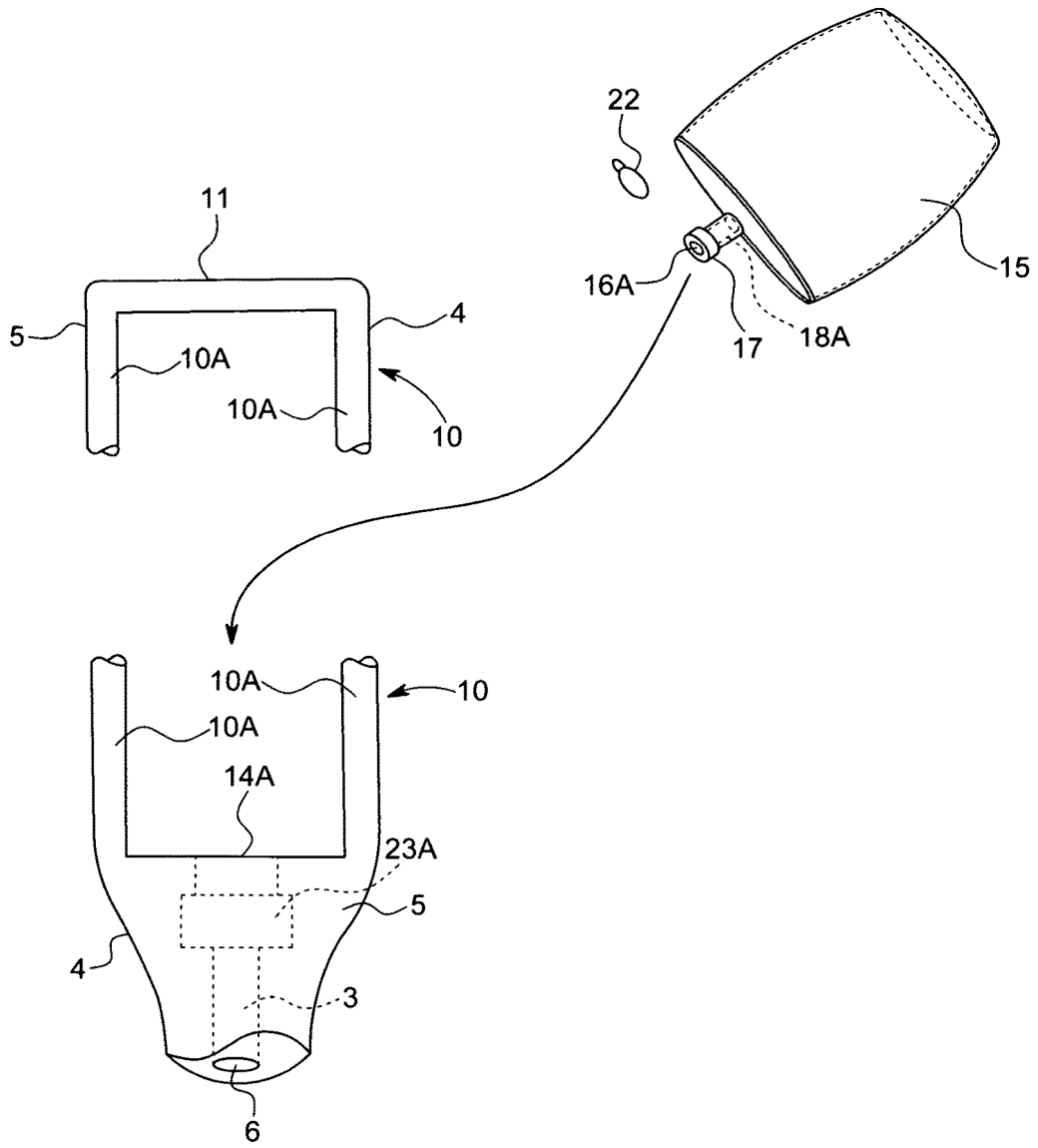
FIGS. 3A and 3B depict perspective views of squeezable bag fluid container assemblies of the claimed invention. In all the views in FIGS. 3A and 3B, dashed lines represent the internal fluid passages.
Figure 3B:
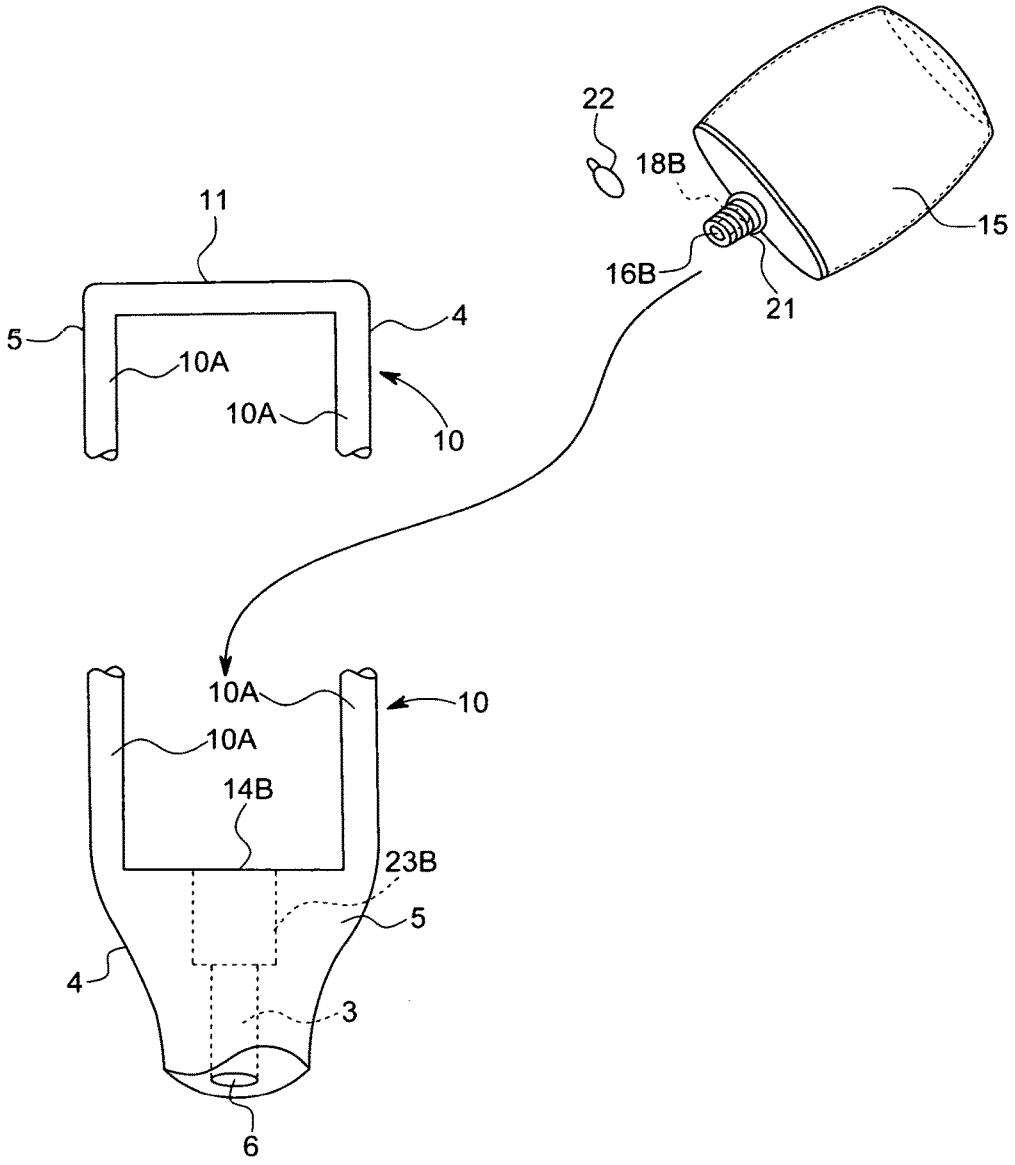

In a first fork embodiment 1A, depicted in FIG. 1A, of the two disclosed fork embodiments, the internal fluid passage 3 branches into at least two branching internal fluid passages 9 at the internal junction 8. The fluid passage 3 passes through the utensil handle body and extends upwards through the handle body toward a fluid container 15 as depicted in FIGS. 2, 3A, and 3B. The branching internal fluid passages 9 extend through at least two fork prongs 7A and exit the tips of the at least two of the prongs at exit holes 2A. These internal fluid passages are separated from an outer surface 4 of the utensil, specifically the utensil handle body, by the material of construction 5 of the utensil. The fluid passage interior surface 6 may be cut or bored through the utensil handle body or may be a fitted tube including a replaceable or disposable tube. In the case of a fork embodiment having the exit hole 2A at the tip of only one of the fork prongs 7A, the branching internal fluid passages 9 and internal junction 8 are unnecessary and can be replaced by a single internal fluid passage 3, 9 that extends to the exit hole 2A at the tip of the fork prong 7A.

A second fork embodiment 1B, depicted in FIG. 1B, does not make use of branching internal fluid passages 9 but rather employs the single exit hole 2B. The fluid passage 3 depicted in FIG. 1C exits the utensil at the one exit hole 2B located at any point between the inner edges of the fork prongs 7B and the juncture of the working end with the handle body, which may or may not be downwardly sloping.

In FIG. 2, the section lines starting at the top of the handle body and extending down to the sectionally drawn cylinder are the cage legs of the handle body which are hidden from view. The remainder of the section lines in FIG. 2, including the aforementioned cylinder, depict the internal fluid passage that extends to the working end of the utensil, as are shown in FIGS. 1A and 1B. The handle body of the utensil shown in FIG. 2 is a hollow cavity defined by at least three handle cage legs. This cavity may or may not contain a fixed or removable cover at its top end. A fluid container is placed into the hollow cavity of the utensil handle body and the container's dispensing end is inserted into the fluid passage.

FIG. 2 depicts the utensil handle body 10 of the claimed invention as a hollow cage structure 10 having at least three cage legs 10A whose material of construction 5 and outer surface 4 may be of the same type and be continuous with the working end of the utensil. A top enclosing structure 11 may or may not be present. The outer surface 4 of the cage legs 10A and the outer surface 4 of the remainder of the handle body 10 may or may not be continuous and the hollow enclosure structure 10 may be detachable or disposable. Into the hollow enclosure structure 10 may be placed a fluid container with a nozzle-like structure to be fitted into a receiver 14A, 14B which connects to the internal fluid passage 3 extending to the working end of the utensil. Fluid is dispensed from the container affixed into the hollow enclosure structure 10 and the receiver 14A, 14B by squeezing or by gravity, or a combination of these forces exerted by the user of the utensil. The user may reach in between the legs 10A of the cage 10 with their fingers, or may squeeze the cage legs 10A in embodiments having flexible cage legs 10A.

Examples of fluid containers to be affixed within the utensil handle body as in FIG. 2 are shown in FIGS. 3A and 3B. In all the views in FIGS. 3A and 3B, dashed lines represent the internal fluid passages. These fluid-dispensing containers can be attached into the utensil handle body 10 by a snap- or screw-fit as in a Luer-Lock fitting 17 as shown in FIG. 3A. An alternative fitting of the fluid container to the top of the handle body 10 is a threaded screw fitting 21 as shown in FIG. 3B. When attached to the utensil handle body 10, fluid may be dispensed to the holes 2A, 2B found at the working end of the utensil, as shown in FIGS. 1A and 1B. The attachments depicted in FIGS. 3A and 3B of the fluid container to the utensil handle body are applicable to the handle body 10 embodiment depicted in FIG. 2. In FIGS. 3A and 3B, the fluid container 15 is a bag that is squeezable or otherwise actuated to dispense fluid whose flow into the internal fluid passage 3 may be commenced after a protective cover 22, as in a peeling adhesive foil, is removed from the container's nozzle 16A, 16B, prior to the nozzle shaft 18A, 18B being affixed to the receiver 14A, 14B by such conventional fittings as the Luer-lock 17 or the screw threads of the screw thread fitting 21.

The fluid container 15 may be for example a disposable polymer bag having approximately zero elasticity, so that it collapses easily as it is emptied. The user may of course remove the bag, either between two legs 10A of the cage 10, or by removing the end 11 of the handle 10 in embodiments having a removable handle end. Thus the user can switch condiments/fluids if desired, although in other embodiments the entire device is disposable with a single condiment therein.

The fittings 17, 21 are located on the nozzle shaft 18A, 18B and fit to mating fittings 23A, 23B in the receiver 14A, 14B. The fluid container 15 to be affixed to the utensil handle body 10 may also be a bottle-type container or may be a syringe-type assembly.

Nozzle-like fittings of fluid containers as depicted in 17 and 21 in FIGS. 3A and 3B are employed to fit the container inside the utensil handle body 10 as in the embodiment shown in FIG. 2.

In the case of disposable embodiments of the claimed invention, the fluid containers may be directly fixed and be pre-filled with the fluid to be dispensed and the sealing cover 22 could be affixed over the exit holes found on the working end of the utensil until the utensils are to be used.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

I claim:

1. A fluidic utensil comprising:

a) a working end fork structure, said working end fork structure having at least two fork prongs;

b) a first exit hole, said first exit hole located at an end of a first fork prong of said at least two fork prongs;

c) a handle, wherein a portion of said handle is constructed as a hollow cage having an interior cavity defined by at least three cage legs, said at least three cage legs spaced from one another and extending down from a top of said handle opposite said working end fork structure to a lower portion of said handle meeting said working end fork structure, said lower portion of said handle having a fluid receiver at a lower end of said hollow cage, said fluid receiver forming an orifice facing upward into the interior cavity of said hollow cage;

d) at least one internal fluid passage, said at least one internal fluid passage extending from said orifice at a bottom of said fluid receiver to said first exit hole; and e) a fluid container having a nozzle end extending into said fluid receiver and removably mechanically engaged therewith, the fluid container removably disposed inside said hollow cage between said at least three cage legs whereby a flow sofa liquid from said fluid container into said at least one internal fluid passage and then to said first exit hole is allowed.

2. The fluidic utensil of claim 1 further comprising:

f) a removable top enclosure structure disposed atop said at least three cage legs at said top of the handle.

3. The fluidic utensil of claim 1 further comprising:

an additional exit hole located at an end of at least a second fork prong of said at least two fork prongs, said at least one internal fluid passage including at least two branches, said at least two branches extending from said first and said additional exit holes, respectively, through the inside of each of said first fork prong and the at least said second fork prong, said at least two branches further extending to an internal junction inside of said working end fork structure at an internal point approximating a juncture of said working end fork structure with said lower portion of said handle.

4. The fluidic utensil of claim 1, wherein said fluid container is a disposable polymer bag.

5. The fluidic utensil of claim 4, wherein the disposable polymer bag has approximately zero elasticity.

6. The fluidic utensil of claim 4, wherein the at least three cage legs are flexible, whereby when pressure is applied to the at least three cage legs, they deform inward and squeeze the disposable polymer bag.

7. The fluidic utensil of claim 1, wherein said at least three cage legs comprises four cage legs, and wherein the hollow cage further comprises four voids, each cage leg of said four cage legs separated from adjacent ones of said four cage legs by one of said four voids on either side, each void of said four voids permitting both visual and physical access to the interior cavity of the hollow cage, whereby users may see the interior cavity of the hollow cage, the contents of the fluid container, and may squeeze the fluid container on opposite sides.

8. A fluidic utensil comprising:

a) a working end fork structure, said working end fork structure having at least two fork prongs;

b) a handle, wherein a portion of said handle is constructed as a hollow cage having an interior cavity defined by at least three cage legs, said at least three cage legs spaced from one another and extending down from a top of said handle opposite said working end fork structure to a lower portion of said handle meeting said working end fork structure, said lower portion of said handle having a fluid receiver at a lower end of said hollow cage, said fluid receiver forming an orifice facing upward into the interior cavity of said hollow cage;

c) an exit hole located on a top surface of said working end fork structure between said at least two fork prongs and a juncture of said working end fork structure with said lower portion of said handle;

d) an internal fluid passage, said internal fluid passage extending from said orifice at a bottom of said fluid receiver to said exit hole; and e) a fluid container having a nozzle end extending into said fluid receiver and removably mechanically engaged therewith, the fluid container removably disposed inside said hollow cage between said at least three cage legs whereby a flow of a liquid from said fluid container into said internal fluid passage and then to said exit hole is allowed.

9. The fluidic utensil of claim 8 further comprising:

f) a removable top enclosure structure disposed atop said at least three cage legs at said top of the handle.

10. The fluidic utensil of claim 8, wherein said fluid container is a disposable polymer bag.

11. The fluidic utensil of claim 10, wherein the disposable polymer bag has approximately zero elasticity.

12. The fluidic utensil of claim 10, wherein the at least three cage legs are flexible, whereby when pressure is applied to the at least three cage legs, they deform inward and squeeze the disposable polymer bag.

13. The fluidic utensil of claim 8, wherein said at least three cage legs comprises four cage legs, and wherein the hollow cage further comprises four voids, each cage leg of said four cage legs separated from adjacent ones of said four cage legs by one of said four voids on either side, each void of said four voids permitting both visual and physical access to the interior cavity of the hollow cage, whereby users may see the interior cavity of the hollow cage, the contents of the fluid container, and may squeeze the fluid container on opposite sides.

* * * * *